US005740705A

United States Patent [19]

Graham

[11] Patent Number: 5,740,705

[45] Date of Patent: Apr. 21, 1998

[54] AUTOMATIC SCREWDRIVER JAWS FOR FACE FRAME HOLES

[75] Inventor: Brian Graham, Boynton Beach, Fla.

[73] Assignee: Nasco Industries Inc., Fort Lauderdale, Fla.

[21] Appl. No.: 700,147

[22] Filed: Aug. 20, 1996

[51] Int. Cl.[6] ..... B25B 23/04; B25B 23/08

[52] U.S. Cl. ..... 81/430; 81/431; 81/433; 81/451

[58] Field of Search ..... 81/57.37, 430, 81/431, 433, 436, 451, 454, 455; 227/107, 112, 120, 123, 124, 125, 129, 130, 7, 11

[56] References Cited

U.S. PATENT DOCUMENTS

| | | | |
|---|---|---|---|
| 1,499,887 | 7/1924 | Snyder et al. | 81/433 |
| 2,247,500 | 7/1941 | Hutchinson, Jr. | 81/431 |
| 2,374,558 | 4/1945 | Moore | 81/433 |
| 3,656,520 | 4/1972 | Caffa | 81/433 |
| 4,671,143 | 6/1987 | Heck et al. | 81/431 |
| 5,234,127 | 8/1993 | Singer et al. | 221/172 |

*Primary Examiner*—William E. Terrell
*Assistant Examiner*—Mark Deuble
*Attorney, Agent, or Firm*—Alvin S. Blum

[57] ABSTRACT

Screw fastener jaws for the driver head of an automatic screw feeding and driving apparatus are disclosed for driving screws in face frame drilled holes. A tubular mandrel communicates with a screw feeding passage and a screwdriver passage at a first end to feed screws into the channel and then drive the screws. Spring action moves a plate to close off the free end of the channel to capture the screw. The plate is wide enough to engage the workpiece surface on both sides of the slanted hole. As the mandrel is advanced into the slanted hole, the plate is forced away from the end of the mandrel, releasing the screw for driving into the workpiece.

6 Claims, 1 Drawing Sheet

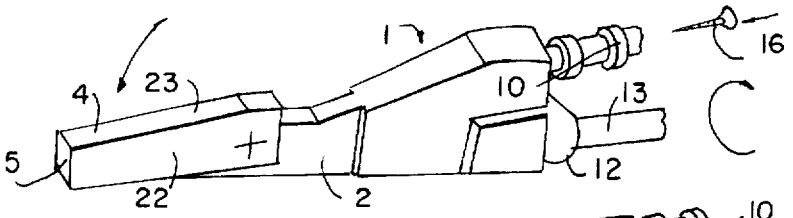
FIG. 1
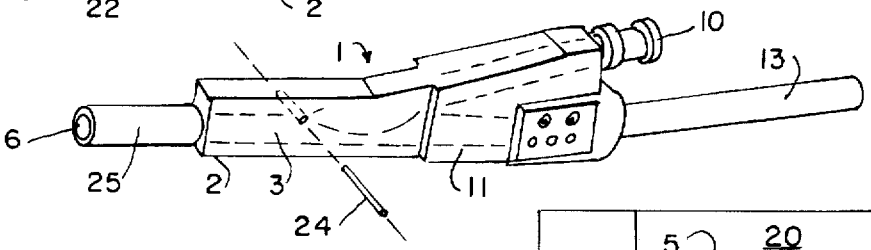
FIG. 2
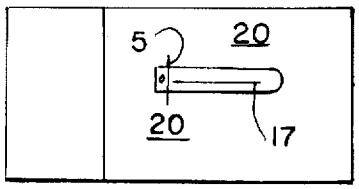
FIG. 3
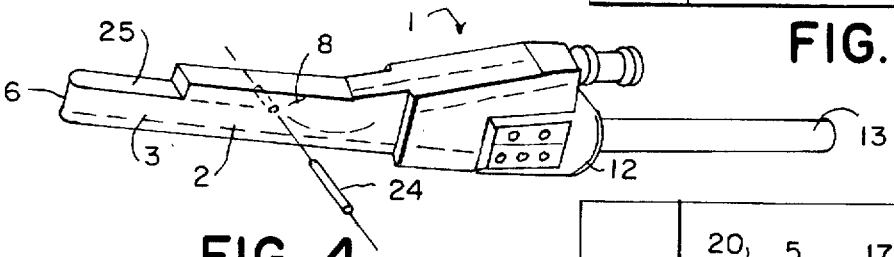
FIG. 4
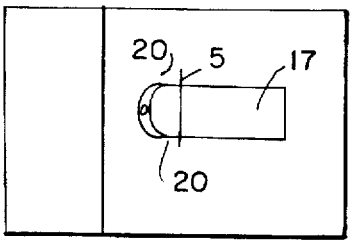
FIG. 5
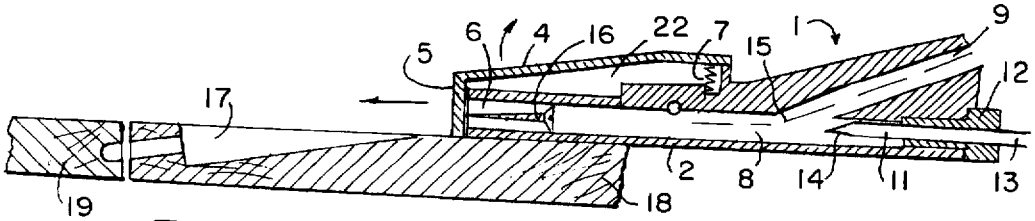
FIG. 6
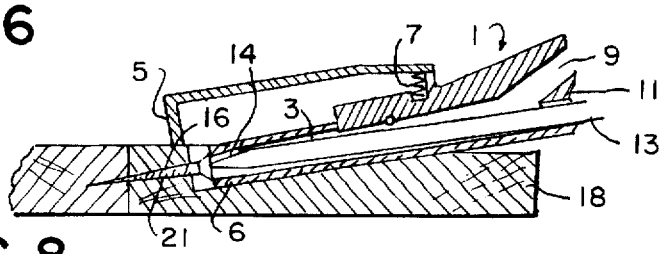
FIG. 7
FIG. 8
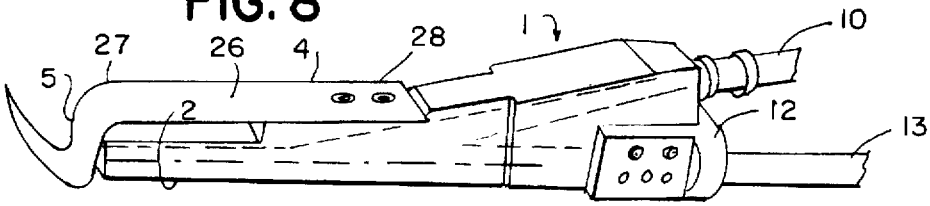

AUTOMATIC SCREWDRIVER JAWS FOR FACE FRAME HOLES

BACKGROUND OF THE INVENTION

1. Field of the Invention

This invention relates to automatic screw feeding and driving machines and more particularly to the jaws holding a screw in those machines especially adapted for inserting the screw into face frame drilled holes.

2. Description of the Prior Art

Automatic screw feeding machines are exemplified by the apparatus disclosed in U.S. Pat. No. 5,234,127. They feed screws automatically from a random batch of screws and deliver them one at a time as needed to a screw holder and driver mechanism.

Screw holding and driving mechanisms used with these machines are exemplified by U.S. Pat. No. 4,671,143. They are provided with jaws which hold the head of the screw with the threaded shank extending outward therefrom for insertion into a hole in the workpiece. As the shank is rotatably advanced by the driver into the hole, the head is released and the screw driven home. These devices are quite effective in the common situation where the hole in the workpiece is orthogonal to the surface. If the head of the screw must not project above the work surface, the hole may be countersunk and a flat head screw employed.

Many construction techniques join two pieces at right angles by using a slanting hole in one piece with a slanting countersunk hole where that surface will not be seen. This is termed face frame drilled holes and it is commonly employed in fabricating frames that will be covered with veneers, such as kitchen cabinets. The screw holding jaws of the prior art devices cannot clear the slanted countersunk holes commonly used in this construction. Consequently, the holes must be made larger or the technique cannot effectively use the automatic screw feeding, holding and driving machinery.

SUMMARY OF THE INVENTION

It is accordingly an object of the invention to provide automatic screw holding and feeding apparatus that can be used effectively for fastening workpieces together that employ face frame drilled holes for the screw fasteners.

It is another object that the device be of simple economical construction with a minimum of moving parts.

It is yet another object that the apparatus be transformed by a single simple motion from a first condition in which the threaded fastener is safely enclosed within a chamber to a second condition in which the point of the fastener is released and positioned correctly for driving into the slanted hole. The screwdriver jaws of the invention include a tubular mandrel that, at a first end, communicates with two passages, a first passage through which a screw is pneumatically blown and a second passage through which the rotary fastener driver or screwdriver passes. Pivotally connected to the mandrel is a hood or cover that is spring biased to a first condition in which the hood covers the second or free end of the mandrel to provide a chamber enclosing the screw and holding it in a desired position. Since the screw may be blown into the mandrel with considerable velocity, it is important for safety considerations that the point be covered.

The pivotal construction of the cover is arranged so that as the mandrel and driver are moved into the sloping countersunk hole in the surface of the workpiece, the cover engages the surface of the workpiece and automatically uncovers the second or open end of the mandrel, exposing the screw in the correct position for driving into the hole by the driver.

These and other objects, advantages and features of the invention will become more apparent when the detailed description is studied in conjunction with the drawings in which like elements are denoted by like reference characters.

BRIEF DESCRIPTION OF THE DRAWINGS

FIG. 1 is a perspective view of the jaw apparatus of the invention.

FIG. 2 is a perspective view of the apparatus of the invention with pivotal cover removed showing a mandrel for use with a drilled face frame hole.

FIG. 3 is a top view of two workpieces to be joined through a face frame hole.

FIG. 4 is a perspective view of the apparatus of the invention with pivotal cover removed showing a mandrel for use with a routed face frame hole.

FIG. 5 is a top view of two workpieces to be joined through a routed face frame hole.

FIG. 6 is a sectional view of the apparatus being advanced into a face frame hole.

FIG. 7 is a sectional view as in FIG. 6 when the apparatus is in position for driving the fastener in the hole.

FIG. 8 is a perspective view of an alternative embodiment of the invention.

DETAILED DESCRIPTION OF PREFERRED EMBODIMENTS

Referring now first to FIGS. 1–7, the jaw apparatus 1 comprises an elongate tubular mandrel 2 having an axial channel 3, a movable cover 4 with a plate 5 that covers the open end 6 of the channel in a first mode of operation, urged by compression spring 7. The other end 8 of the channel is in communication with two converging passages, a first passage 9 connected to known one-at-a-time pneumatic fastener feeding apparatus 10, and a second passage 11 connected to the housing 12 of a well known fastener driver apparatus coaxially aligned with the channel. Fastener driver 13 may have a screwdriver tip 14 or other fastener engaging tip as required. The driver 13 is spring loaded to retreat behind the junction 15 of the passages while a fastener 16 is blown into the channel and stopped by plate 5. The fastener is held safely within the compartment formed by the channel and the plate as the apparatus is positioned at a face frame hole 17 cut slantingly in a first workpiece 18 to be joined to a second workpiece 19 as shown in FIG. 6. The plate 5 is wide enough to extend to the surface 20 on both sides of the hole 17 routed (FIG. 5) or drilled (FIG. 6) slantingly into the surface of workpiece 18. When the housing 12 of the driver apparatus is pushed forward in the usual manner of operation of such machines, the fastener driver tip 14 advances past junction 15, rotating and engaging the threaded fastener 16. As the mandrel moves down into hole 17, the plate 5, engages both surfaces 20 on the sides of the hole and is forced upward and away from covering open end 6 of the channel. This allows the fastener to be driven through the remainder 21 of the hole in workpiece 18 and into the second workpiece 19, thereby joining the two with a fastener whose head is below surface 20. The cover 4 is comprised of two parallel opposed side panels 22 joined to plate 5 and a top panel 23 joined to the plate and side panels. A roll pin 24 in the side panels pivotally joins the cover to the mandrel, and compression spring 7 between cover and mandrel urges the plate to cover the channel when not being forced away as the mandrel enters the hole.

The tip 6 of the mandrel may take the half-cylindrical shape shown in FIG. 4 with the external sectional shape 25 being rectangular to conform to the shape of the hole cut by a router as shown in FIG. 5.

Alternatively, the tip end 6 of the mandrel may take the straight square cut shape shown in FIG. 2 with the external sectional shape 25 being cylindrical to conform to the shape of the hole cut by a drill as shown in FIG. 3.

Referring now to FIG. 8, in an alternative embodiment of the invention, the cover comprises an elongate spring attached at a first termination 27 to a plate 5 and at a second termination 28 to the mandrel. The bottom of plate 5 where it contacts the workpiece surface is provided with a curved lip 29 for reduced frictional resistance. The spring, plate and lip may be formed from a single piece of material, such as spring steel.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

What is claimed is:

1. Jaw apparatus adapted to be fitted to a driver head of an automatic screw feeding machine for holding a threaded fastener prior to and during insertion of the fastener in a face frame hole in a support surface by a fastener driver of the automatic screw feeding machine, the jaw apparatus comprising:

an elongate tubular mandrel having first and second ends and an axial channel therethrough;

the mandrel attached at the first end to the driver head and the channel being in communication with a first passage through which a fastener is pneumatically passed, and in communication with a second passage through which the fastener driver passes;

cover means for covering the second end of the mandrel in a first mode of operation, the cover means including a flat plate disposed transverse to the axial channel, covering the second end, and having a dimension great enough to extend completely across the hole, in the first mode of operation;

connecting means for movably connecting the plate to the mandrel such that the plate will move progressively from the first mode of operation in which the fastener is held within a compartment formed by the mandrel channel and the plate to a second mode of operation in which the plate is forced away from covering the mandrel to release the fastener by the support surface across the hole as the mandrel is inserted in the hole; and spring bias means for urging the cover means to the first mode of operation.

2. Jaw apparatus adapted to be fitted to a driver head of an automatic screw feeding machine for holding a threaded fastener prior to and during insertion of the fastener in a face frame hole in a support surface by a fastener driver of the automatic screw feeding machine, the jaw apparatus comprising:

an elongate tubular mandrel having first and second ends and an axial channel therethrough;

the mandrel attached at the first end to the driver head and the channel being in communication with a first passage through which a fastener is pneumatically passed, and in communication with a second passage through which the fastener driver passes;

cover means for covering the second end of the mandrel in a first mode of operation, the cover means including a flat plate disposed transverse to the axial channel, covering the second end, and having a dimension great enough to extend completely across the hole, in the first mode of operation to engage the support surface on both sides of the hole;

two parallel side panels having a forward edge joined to the plate;

a top panel having a front edge joined to the plate and joined to both side panels; and pivotal connections between the side plates and the mandrel for movably connecting the plate to the mandrel such that the plate will move progressively from the first mode of operation in which the fastener is held within a compartment formed by the mandrel channel and the plate to a second mode of operation in which the plate is forced away from covering the mandrel to release the fastener by the support surface across the hole as the mandrel is inserted in the hole; and spring bias means for urging the cover means to the first mode of operation.

3. Jaw apparatus adapted to be fitted to a driver head of an automatic screw feeding machine for holding a threaded fastener prior to and during insertion of the fastener in a face frame hole in a support surface by a fastener driver of the automatic screw feeding machine, the jaw apparatus comprising:

an elongate tubular mandrel having first and second ends and an axial channel therethrough;

the mandrel attached at the first end to the driver head and the channel being in communication with a first passage through which a fastener is pneumatically passed, and in communication with a second passage through which the fastener driver passes;

cover means for covering the second end of the mandrel in a first mode of operation, the cover means including a plate disposed transverse to the axial channel, covering the second end, and having a dimension great enough to extend completely across the hole, in the first mode of operation to engage the support surface on both sides of the hole; and an elongate spring member attached at a first termination to the plate and extending axially alongside the mandrel to a second termination connected to the mandrel away from the second end of the mandrel for movably connecting the plate to the mandrel such that the plate will move progressively from the first mode of operation in which the fastener is held within a compartment formed by the mandrel channel and the plate to a second mode of operation in which the plate is forced away from covering the mandrel to release the fastener by the support surface across the hole as the mandrel is inserted in the hole, the spring member springably urging the cover means to the first mode of operation.

4. The jaw apparatus according to claim 3, in which the portion of the plate that contacts the support surface is provided with a curved lip for reduced frictional resistance.

5. The jaw apparatus according to claim 4, in which the spring member and plate are coextensive and formed of a single piece of material.

6. The jaw apparatus according to claim 3, in which the portion of the plate that contacts the support surface is provided with a curved lip for reduced frictional resistance.

* * * * *